US009055856B2

(12) United States Patent
Bühlmeyer et al.

(10) Patent No.: US 9,055,856 B2
(45) Date of Patent: Jun. 16, 2015

(54) DISHWASHER WITH A PLASTIC FRAME PART WHICH IS FIXED TO A TREATMENT CONTAINER

(75) Inventors: Alexander Bühlmeyer, Bopfingen (DE); Werner Haltmayer, Dinkelsbühl (DE); Cengiz Kücük, Syrgenstein (DE); Anton Oppel, Syrgenstein (DE); Manfred Seeβle, Gerstetten (DE); Wilhelm Thibaut, Sontheim (DE); Heiko Wendland, Lauingen (DE); Werner Öfele, Blindheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1075 days.

(21) Appl. No.: 12/084,162

(22) PCT Filed: Oct. 6, 2006

(86) PCT No.: PCT/EP2006/067148
§ 371 (c)(1),
(2), (4) Date: Apr. 24, 2008

(87) PCT Pub. No.: WO2007/048697
PCT Pub. Date: May 3, 2007

(65) Prior Publication Data

US 2009/0095335 A1 Apr. 16, 2009

(30) Foreign Application Priority Data

Oct. 25, 2005 (DE) ..... 20 2005 016 735 U

(51) Int. Cl.
*A47L 15/42* (2006.01)

(52) U.S. Cl.
CPC ..... *A47L 15/4246* (2013.01); *A47L 15/4263* (2013.01); *A47L 15/4257* (2013.01)

(58) Field of Classification Search
CPC ..... A47L 15/4246; A47L 15/4257; A47L 15/4263
USPC ..... 134/56 D, 25.2, 57 D, 58 D, 200; 312/228, 228.1
See application file for complete search history.

(56) References Cited

U.S. PATENT DOCUMENTS 3,344,817 A * 10/1967 Connard ..... 148/211
3,877,460 A * 4/1975 Lotz et al. ..... 126/200

(Continued)

FOREIGN PATENT DOCUMENTS

DE 1 249 206 9/1967
DE 24 20 302 11/1975

(Continued)

OTHER PUBLICATIONS

Machine translation of DE 4013771 (Oct. 1991).*

(Continued)

*Primary Examiner* — Joseph L Perrin
(74) *Attorney, Agent, or Firm* — James E. Howard; Andre Pallapies

(57) ABSTRACT

A dishwasher includes a plastic frame that is fixed to a treatment container. The front of the treatment container has a filling opening which can be closed by a door. The treatment container has a container casing, which comprises side walls, a container roof, and the frame. The frame forms a front face of the treatment container and is connected to the container casing in an interlocking manner.

17 Claims, 3 Drawing Sheets

(56) References Cited

U.S. PATENT DOCUMENTS

| | | | | |
|---|---|---|---|---|
| 4,359,250 | A * | 11/1982 | Jenkins | 312/228 |
| 5,860,436 | A | 1/1999 | Hobday | |
| 5,994,288 | A * | 11/1999 | Urfer et al. | 510/470 |
| 6,045,203 | A | 4/2000 | Marks et al. | |
| 6,367,492 | B1 * | 4/2002 | Brown | 134/166 R |
| 6,375,031 | B1 * | 4/2002 | Kwan | 220/663 |
| 2001/0023561 | A1 * | 9/2001 | Henbid et al. | 52/222 |
| 2005/0017609 | A1 * | 1/2005 | Kucuk et al. | 312/228 |

FOREIGN PATENT DOCUMENTS

| | | |
|---|---|---|
| DE | 25 43 822 | 4/1977 |
| DE | 4013771 | * 10/1991 |
| DE | 44 43 920 | 5/2000 |
| GB | 2 201 886 | 9/1988 |

OTHER PUBLICATIONS

Machine translation fo DE 4443920 (May 2000).*

International Search Report PCT/EP2006/067148.

* cited by examiner

DISHWASHER WITH A PLASTIC FRAME PART WHICH IS FIXED TO A TREATMENT CONTAINER

BACKGROUND OF THE INVENTION

The invention relates to a dishwasher, particularly a domestic dishwasher, that has a container hood made at least partly of metal and includes a container casing, consisting of two side walls and a container roof, and also a rear wall, as well as a rinsing tub, not belonging to the container hood and made of plastic, as the base of a treatment container for accommodating items to be rinsed, with said container having a filling opening that can be closed by means of a door.

The treatment container of dishwashers is usually made of a special high-grade stainless steel. The treatment container comprises at least two constituent parts. What is termed the container casing embodies the side walls and roof of a container hood of the treatment container. A separately embodied rear wall is a constituent part of the container hood and is joined to the container casing in a liquid-tight manner by welding. The container hood's constituent parts are for reasons of corrosion resistance made of a high-grade chromium-nickel steel, which is relatively expensive. Chromium-nickel steel is used because, for example, the rear wall is joined to the container casing by welding. Using chromium-nickel steel ensures corrosion resistance at the weld seams also.

For cost reasons it would be advantageous if major constituent parts of the container hood could be made from a more ordinary and economical chromium steel because production costs can then be reduced. The problem with joining chromium steel to chromium-nickel steel by welding is that what is termed crevice corrosion can occur in a dishwasher in the region of the join.

For that reason recourse is made, as already described in the introduction, to using more expensive chromium-nickel steel since corrosion may otherwise occur in regions continually wetted with liquid or moisture, for example at sections that are welded together and in seal receptacles.

A typical structure of a conventional dishwasher is described in U.S. Pat. No. 6,045,203. The dishwasher therein disclosed has a bent container casing which on its filling opening is provided with a flange embodying a front area and having rounded upper corners. To make it easier to integrate the dishwasher into a built-in kitchen, corner members are detachably fitted onto the upper corners to produce square upper corners. The corners as well as trim members fitted on the edges are each made of a plastic material and are fitted on the container hood's flange. The corner members themselves are secured to the trim members. Highly corrosion-resistant materials are employed in producing the dishwasher described in the US publication, with expensive stainless steel being preferred. Only little deformation stability, for example during transportation, is provided owing to embodying the container casing, consisting of the side walls and container roof, as a single piece.

A household appliance having a treatment container exhibiting greater stability than the dishwasher described above is known from DE 44 43 920 C2. For installing or securing side walls, in particular if an insulation (for example noise and/or thermal insulation) is to be provided between the treatment container and side walls, said household appliance has a frame serving also to install the appliance and make it rigid. To make it easily possible to separate the parts made of different materials, the German (DE) patent specification provides for releasably joining at least one frame part to the treatment container in a form-fit manner. To ensure stability at the same time, frame parts on opposite sides of the treatment container are releasably mutually joined around the treatment container in a form-fit manner and braced. A frame part consists therein of U-shaped profile rods, with preferably two frames being arranged fitted over the treatment container, one adjacent to its filling opening and one adjacent to its rear side, with the free ends of the frame limbs pointing downwards. Whereas the rinsing container is to be made of a special stainless steel, the frame parts can be made of a plastic material. The front U-frame forms the edging of a filling opening of the rinsing container. The U-frame is for that purpose made of profile rods substantially rectangular in cross-section and has a rectangular projection that is accommodated in recesses in the rinsing container. The U-frames furthermore have receptacles for side walls of a machine-housing trim, for an insulating mat, and for a seal.

DE 25 43 822 and DE 24 20 302 disclose dishwashers each having modules made of metal and of plastic. Said modules are in both cases joined to each other using a seal. Plastic is therein in each case used for making the dishwashers' rinsing tubs. The consideration underlying that approach is that the costs of producing the domestic appliances can be reduced by extensively replacing with plastic those metal components requiring to be made of an expensive special stainless steel for reasons of corrosion resistance.

BRIEF SUMMARY OF THE INVENTION

The object of the present invention is therefore to disclose a dishwasher that can be produced economically more favorably.

The inventive dishwasher, particularly a domestic dishwasher, has a container hood made at least partly of metal and includes a container casing, consisting of two side walls and a container roof, and also a rear wall, as well as a rinsing tub, not belonging to the container hood and made preferably of plastic, as the base of a treatment container for accommodating items to be rinsed, with said container having a filling opening that can be closed by means of a door, with a part, in particular a frame part, that has a sealing function for rinsing liquid being located on the front end of the container hood. The frame part is therefore secured in the region of the filling opening on the container hood, for example the container hood is thereby partially covered by the frame part.

The frame part preferably embodies a front area of the treatment container's interior space. In other words it means the container casing is "two-part". The actual container casing constitutes one, major constituent part. The frame part constitutes a further part occupying a smaller area.

In a further embodiment the frame part is joined to the container casing in a form-fit and/or materially bonded manner.

In a further embodiment variant the frame part is made of plastic. No corrosion will consequently occur on the seal recess.

The container casing or the container casing and rear wall is/are preferably made of ordinary steel, in particular chromium steel. If the container casing and rear wall are made of ordinary steel, then the gap region between the rear wall and container casing will in order to avoid corrosion need to be sealed by means of, for example, an elastic compound made of plastic.

In a preferred embodiment of the invention a sealing element is provided in an overlapping section between the frame part and container hood for preventing crevice corrosion. The sealing element will ensure that no moisture or liquid can penetrate the gap formed within the overlapping section between the frame part and container casing and possibly remain there owing to capillary effects.

That will enable the container hood especially advantageously to be made of ordinary steel, in particular chromium steel, as a result of which substantial savings effects can be achieved compared with conventional dishwashers owing to an economically far more favorable starting material.

According to a further embodiment of the invention the frame part is embodied as U-shaped and having its two limbs fitted pointing downwards over the container casing's filling opening. That will produce the aforementioned overlapping section between the frame part and container casing. A particularly simple form-fit link between said two constituent parts can be achieved thereby.

It is especially preferred for the sealing element to be secured on the frame part. Provision is made in particular to locate the sealing element in a receptacle of the frame part. Since in contrast to the rest of the treatment container the frame part is made of a plastic material, a corresponding receptacle can be produced particularly simply by appropriately designing an injection-molding tool. Were the sealing element to be secured on or in the container hood, then a plurality of bending operations would be necessary for forming the preferred receptacle. That is more effort-intensive than the preferred variant and hence will increase costs.

The sealing element is made according to a further advantageous embodiment of a different material from the frame part, in particular rubber or silicone. Other, comparable materials exhibiting a corresponding Shore hardness can also be used.

In a further advantageous embodiment it is provided for the frame part to have at least one further receptacle in which is located a door seal of the dishwasher. The plastic frame can where applicable also be provided with a further sealing profile in the region of the treatment container's front area. Said sealing profile is also referred to as a keder seal.

Locating the sealing element and/or door seal on or in the frame part will then be particularly advantageous because the frame part can be produced together with the sealing element and/or door seal in one two-component injection-molding process. The steps of integrating the sealing element or door seal otherwise requiring to be performed manually will in that case be dispensed with. The same will also apply, of course, if the dishwasher is to be provided with keder seals.

Because the frame part and container casing together embody a part of the treatment container, it will be expedient for the frame part and container casing to be non-releasably mutually joined in a form-fit manner. They will be joined preferably by means of welding lugs embodied as a single piece with the frame part.

In a further advantageous embodiment the frame part is embodied such that it is capable of absorbing laterally and/or top-acting and/or bottom-acting forces. The required stability can be achieved by, for example, embodying suitably embodied, mutually regularly spaced webs in the frame part. It is therein particularly preferred for crossing webs to be provided. The cross-sectional profile can be given the shape of a regular lattice (90° crossover angle), for example, or of honeycombs.

The frame part's being embodied for force absorption is of significance for the brief periods of transportation, performed usually with the aid of clamp-lift trucks engaging laterally with the dishwasher, and warehousing, during which a plurality of dishwashers may be stacked one upon the other. The forces exerted on other housing components, usually made of a metal and easily deformed owing to their extensive area, will in that case be reduced.

It is furthermore advantageous for a closing plate to be embodied as a single piece with and in the frame part, which plate can be brought to interact with a closing mechanism on or in the door when the filling opening is closed by means of the door. The closing plate, hitherto a separate component and joined to the treatment container by means of, for example, a screw or rivet joint, can now be embodied as a single piece with the frame part during an injection-molding process. Production can thereby be further simplified during assembling of the dishwasher.

In a further expedient embodiment the frame part is provided with a connecting element for connecting to a hinge plate provided on or in the dishwasher's housing.

Summarizing, the invention can be seen in that the treatment container has, alongside the container casing, a frame part that embodies a part of the side walls and of the container roof. In other words the treatment container, which is to say more precisely the container casing, is embodied as being two-part. The term "treatment container" is in this context to be understood as just the part having the side walls and container roof. The naturally present rear wall is not taken into consideration here. The treatment container's two-part nature will advantageously enable ordinary steel, in particular chromium steel, to be used, as a result of which the dishwasher can be produced economically far more favorably.

Further advantages, features, and expediencies of the invention are described below with the aid of the exemplary embodiment shown in figure form.

DETAILED DESCRIPTION OF THE PRESENT INVENTION

Figure 1:
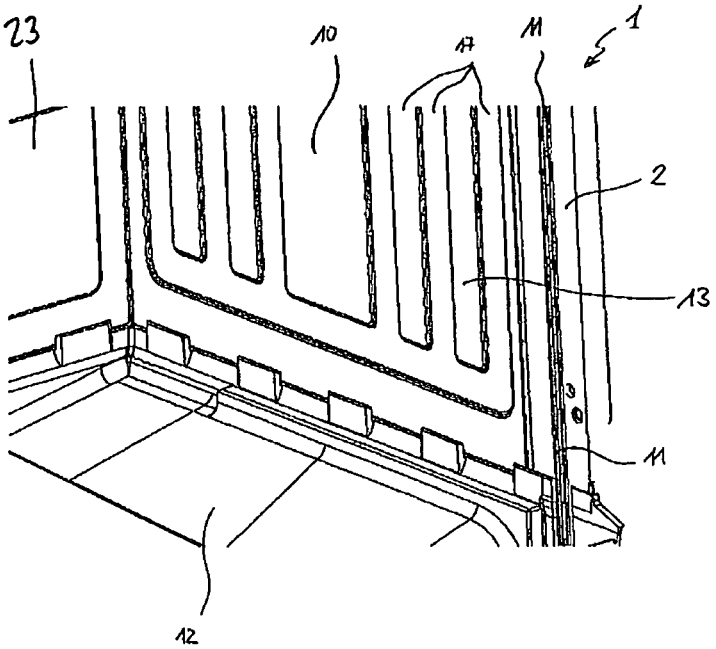
FIG. 1 is a perspective sectional view of a treatment container in accordance with an exemplary embodiment of the present invention.

FIG. 1 is a perspective view of a section across the interior of a treatment container 1 of an inventive dishwasher. A container hood is joined by means of a rinsing tub 12 made of, for instance, plastic to a container casing 10 and a frame part 2. The rinsing tub 12 forms the base of the treatment container 1 and is part of a floor section (not shown) for example for accommodating device units and/or receiving leaking water. The inventive dishwasher stands on the floor with its floor section. The container hood consists of the container casing 10 and rear wall 23 and is located or, as the case may be, fitted on the floor section or, as the case may be, the rinsing tub 12. The frame part 2 and the container casing 10 are shown in the figure as the right-hand side wall 13 of the treatment container 1, with the left-hand side wall 13 and the container roof not shown. The container casing 10, which for increased stability is provided with a plurality of recesses 17, and the rear wall 23 are made of an ordinary steel, in particular a chromium steel. The container hood can also be in part not made of metal, for example the container roof can be made of plastic. The frame part 2 is made of a plastic material and is produced using, for example, an injection-molding process. The perspective view of FIG. 1 also shows a door seal 11 that is integrated in the frame part 2 and seals the treatment container 1 against a door (not visible in the figure) of the dishwasher.

Figure 2:
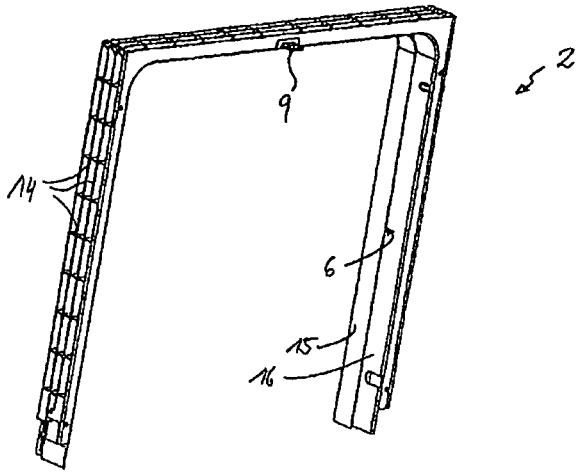
FIG. 2 is a perspective view of a frame in accordance with an exemplary embodiment of the present invention.

The frame part 2, of which a perspective view is shown in FIG. 2, is provided with a plurality of webs 14 that give it a high degree of rigidity and stability. The frame part 2, which embodies a front area of the treatment container, accounts for a portion of the entire dishwasher's stability. Said part being made of a plastic material, there will be no problems whatever in terms of the corrosion resistance of the container hood when it is joined to the ordinary steel of the treatment container. Problems with corrosion would occur were the frame part 2 made of a high-grade stainless steel (for example chromium-nickel steel) and said two components welded together. Only providing the frame part 2 made of plastic will allow the more ordinary, economically more favorable material to be used.

Moreover, the choice of said material also has further advantages for the production process. Thus, for example, a closing plate 9 embodied hitherto as a separate component can during said process be embodied along with the frame part 2 as a single piece therewith. It is equally possible to provide a receptacle 6 serving to accommodate the door seal 11 (see FIG. 1), with the use of plastic as the material in the receptacle 6 precluding the occurrence of corrosion.

The frame section that is assigned the reference numeral 15 and extends from the right-hand limb across the horizontal section to the left-hand limb of the frame part 2 is a constituent part of the side walls or, as the case may be, roof inside the treatment container 1. The frame section that is assigned the reference numeral 16 and extends likewise from the right-hand limb across the horizontal section to the left-hand limb of the frame part 2 conversely does not face the interior of the treatment container 1 when the door is closed. Rather it is the case that the frame section 16 accommodates a corresponding section or segment of the dishwasher's door and is in particular not exposed to any moisture or liquid.

Figure 3:
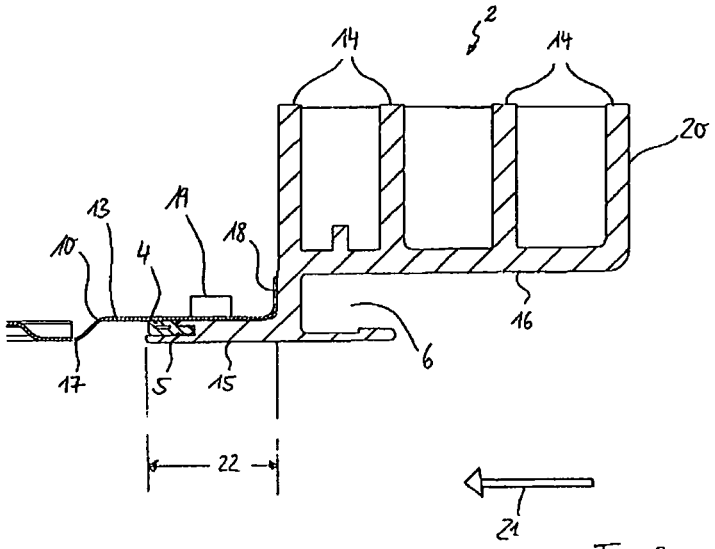
FIG. 3 is a cross-section of a frame in accordance with an exemplary embodiment of the present invention.

FIG. 3 shows a cross-section through the frame part 2 as well as a section of the side wall 13. The filling direction while the dishwasher is being loaded is therein indicated by the arrow assigned the reference numeral 21. It can readily be seen from the cross-sectional representation that the frame part 2 is provided with, for instance, four webs 14 that give the frame part 2 a high degree of stability. The web assigned the reference numeral 20 embodies the front area of the treatment container. The already cited door seal 11 is inserted into the receptacle 6, thereafter fitting against the frame section 16.

Embodied on the end of the frame part 2 and facing the inside of the dishwasher is a further receptacle 5 embodied for accommodating a sealing element 4. The sealing element 4, which is embodied from rubber, a silicone, or a comparable material having a corresponding Shore hardness, fits close against the side wall 13 or, as the case may be, the frame part 2. The sealing element 4 will prevent the ingress of moisture and liquid into an overlapping section 22. The sealing element 4 will in particular prevent the ingress of moisture and liquid owing to a capillary effect in the region of the overlapping section 22 in which a section of the side wall 13 fits against the frame section 15 of the frame part 2.

The container casing 10 is joined to the frame part 2 by means of what are termed welding lugs 19. Prior to joining the frame part is provided at the site of the welding lugs 19 with a multiplicity of projections that are inserted into the container casing through correspondingly shaped bore holes. The projections, embodied as a single piece with the frame part 2, can through being thermally deformed be remelted into the shape shown in FIG. 3 (spherical-head cross-sections are also conceivable) so that the welding lug will be larger in diameter than the corresponding bore hole. A secure form-fitting and non-releasable join will have been established thereby. To ensure a secure join between the frame part 2 and container casing 10, the end, facing the frame part 2, of the container casing 10 is bent round and fits likewise against a wall section of the frame part 2.

Furthermore FIG. 3 again shows the recess 17, described in connection with FIG. 1, which increases the container hood's stability.

LIST OF REFERENCE NUMERALS

1 Treatment container
2 Frame part
4 Sealing element
5 Receptacle
6 Receptacle
9 Closing plate
10 Container casing
11 Door seal
12 Rinsing tub
13 Side wall
14 Web
15 Frame section
16 Frame section
17 Recess
18 Side-wall section
19 Welding lug
20 Web
21 Filling direction
22 Overlapping section
23 Rear wall

The invention claimed is:

1. A dishwasher comprising:
a container hood comprising:
a container casing made at least partly of metal and including two side walls and a container roof; and a rear wall;
a plastic rinsing tub;
a door; and
a corrosion-resistant frame sealing a front end of the container hood and including crossing webs for absorbing forces on the container hood, wherein the frame comprises a receptacle in which is located a door seal of the dishwasher.

2. The dishwasher of claim 1, wherein the plastic rinsing tub forms a base of the treatment container.

3. The dishwasher of claim 1, wherein the frame embodies a front area of an interior space of the treatment container.

4. The dishwasher of claim 1, wherein the frame is joined to the container casing in one of a form-fit and materially bonded manner.

5. The dishwasher of claim 1, wherein the frame comprises a plastic.

6. The dishwasher of claim 1, wherein one of the container casing and the rear wall comprises a steel.

7. The dishwasher of claim 6, wherein the steel comprises a chromium steel.

8. The dishwasher of claim 1, further comprising a seal in an overlapping section between the frame and the container casing.

9. The dishwasher of claim 8, wherein the seal is secured to the frame.

10. The dishwasher of claim 9, wherein the seal is in a receptacle of the frame.

11. The dishwasher of claim 8, wherein the seal comprises a material that is different from a material of the frame.

12. The dishwasher of claim 11, wherein the seal comprises a rubber, thermoplastic elastomer, or silicone.

13. The dishwasher of claim 1, wherein the frame comprises a U-shape having two limbs of the U-shape pointing downwards over a filling opening of the container casing.

14. The dishwasher of claim 1, wherein two of the frame, a seal overlapping a section between the frame and the container casing, and a door seal are produced by a 2-component injection-molding.

15. The dishwasher of claim 1, wherein the frame and the container casing are joined by welding lugs embodied as a single piece with the frame.

16. The dishwasher of claim 1, wherein the frame includes a closing plate that interacts with a closing mechanism on the door.

17. The dishwasher of claim 1, further comprising lugs injected onto the frame onto which the two side walls can latch.

* * * * *